US005647640A

United States Patent [19]

Heintzmann et al.

[11] Patent Number: 5,647,640

[45] Date of Patent: Jul. 15, 1997

[54] CONTINUOUSLY OPERATING MINING MACHINES WITH PLOW AND CONVEYOR CHAINS AND METHOD OF OPERATING SAME

[75] Inventors: Peter Heintzmann, Bochum; Kuno Guse, Witten, both of Germany

[73] Assignee: Bochumer Eisenhutte Heintzmann GmbH & Co. KG, Bochum, Germany

[21] Appl. No.: 600,598

[22] Filed: Feb. 13, 1996

[30] Foreign Application Priority Data

Feb. 14, 1995 [DE] Germany ..... 19 504 779.6

[51] Int. Cl.[6] ..... E21C 35/24; B65G 43/00

[52] U.S. Cl. ..... 299/1.6; 198/810.04; 299/34.07

[58] Field of Search ..... 299/1.6, 1.9, 34.07; 198/810.04, 813

[56] References Cited

U.S. PATENT DOCUMENTS 4,657,131 4/1987 Brychta et al. ..... 198/810.04

FOREIGN PATENT DOCUMENTS 3841884 6/1990 Germany ..... 299/1.6

4319512 12/1994 Germany .

*Primary Examiner*—David J. Bagnell

*Attorney, Agent, or Firm*—Herbert Dubno

[57] ABSTRACT

A mining machine especially for seam mining as in the mining of coal has a sensor for incipient sag of the plow pass of the continuously driven endless chain and a computer to which the sensor is connected and which controls the conveyor drive at the upstream end of the plow pass and the downstream end of a conveyor pass to reduce the speed of this drive until the plow pass is retensioned and any sag is accumulated at the conveyor pass. This arrangement eliminates problems with dislocation of the mining plow or of the conveyor flights as they are guided by guide devices onto the plow trough at the upstream end of the plow pass.

11 Claims, 3 Drawing Sheets

CONTINUOUSLY OPERATING MINING MACHINES WITH PLOW AND CONVEYOR CHAINS AND METHOD OF OPERATING SAME

FIELD OF THE INVENTION

Our present invention relates to a mining machine and especially a seam-mining machine for coal and the like. More particularly, the invention relates to a continuously operating mining machine for seam-like minerals, especially coal, of the type having a plow trough along which a plow is guided in a plow pass of a continuous chain, and a conveyor trough in which one or more flights of the chain are received to displace mineral matter excavated along this conveyor trough.

BACKGROUND OF THE INVENTION

A mining machine of the type in which a plow trough is disposed ahead of a conveyor trough, one or more plows are carried by an endless chain passing around reversing stations at opposite ends of the trough and the chain also has conveyor flights which are displaceable in a conveyor trough rearwardly of the plow trough to displace the mined material, is known inter alia, from German patent document DE 43 19 512 A1.

At each of the reversing stations, a sprocket wheel is provided and the endless, statically tensioned chain, passes around these sprocket wheels.

One of the sprocket wheels, i.e. the one at the end of the conveyor pass and at the upstream side of the plow pass, is connected to a conveyor drive while the other sprocket wheel in the region of the upstream side of the conveyor pass and the downstream end of the plow pass is connected to a plow drive. Both drives are operated to displace the chain and each drive can be a three-phase alternating current motor connected to the shaft of the respective sprocket wheel.

Furthermore, at least downstream of the sprocket wheel of the conveyor drive, insertion or guide elements are provided for feeding the plow bodies and the conveyor bodies into the respective guides of the plow trough.

In the continuous operation of such machines, chain sag can develop. The chain sag can result from a clamping of the chain along the plow pass or an increase in resistance in the mining operation.

Because of the high tension on the chain in the plow pass, the chain can stretch somewhat to form the sag. Since the chain tension is somewhat less in the conveyor pass, the chain usually is free from stretch in this position. Where the deformation is greater than the static tension on the chain, the actual sag formation develops. The sag is effectively an increase in the length of the chain and is similar to the sag which arises in cables or the like.

The formation of said sag can be avoided by providing the chain under extremely high pretension. While this is effective for the mining of uniform seams or even seams in which changes in the seam structure or the mineral structure is slight, problems are encountered when the seam contains rock or regions of varying hardness and considerable force is required to overcome engagement of the plow with these parts of the seam to be mined.

Even though a greater force may be applied, sag may nevertheless develop. Since the sag is particularly problematical immediately downstream of the conveyor drive sprocket wheel, where the aforementioned guide elements are provided, the plows and/or the conveyor flights may not be properly guided into the plow trough and can cant, twist or slip out of place, requiring time-consuming and expensive operations to repair the apparatus.

OBJECTS OF THE INVENTION

It is, therefore, the principal object of the present invention to provide a continuously operating mining machine of the aforedescribed type in which chain sag or the detrimental effects thereof, are largely suppressed.

Another object is to provide a method of operating a mining machine of the type described to suppress the chain sag or detrimental effects thereof.

Still another object of the invention is to provide an improved mining machine which will overcome drawbacks of prior art machines.

SUMMARY OF THE INVENTION

These objects and others which will become apparent hereinafter are attained, in accordance with the invention by suppressing the sag in the plow pass and detrimental effects of chain sag in this region by directly or indirectly measuring the chain sag utilizing appropriate measurement techniques and, in response thereto, operating a control or regulating device for at least the conveyor drive so that the speed of the conveyor drive is so reduced in accordance with the sag formation that in the plow pass the chain is retensioned and any sag accumulates in the conveyor trough or along the conveyor pass.

The process of the invention can be carried out in various ways. In one preferred approach, the formation of the sag is detected by monitoring deformations and/or offset of the machine which themselves signal a difference in the tensions of the passes on opposite sides of the sprocket wheel provided with the conveyor drive. This can, for example, be the offset between the plow trough and the conveyor trough which can be coupled together by an appropriate linkage.

Alternatively, the sag may be measured by monitoring a change in the speed of the plow drive. The formation of the sag can, however, also be monitored with sensors which are located in the region of the reversing station, provided with the conveyor drive and at the upstream side of the plow pass. In this case, the sag may be geometrically measured.

The invention is based upon our discovery that, with a continuously operating mine machine of the type described, the sag which develops at the upstream side of the plow pass can be transferred to the conveyor pass simply by reducing the speed of the conveyor drive.

While normally the conveyor drive and the plow drive are operated synchronously or with identical speeds and sag does not occur in the plow pass, in practice resistance in the seam or clamping of the plow pass chain can result in a slowing of the advance of the chain along the plow pass relative to the conveyor drive which gives rise to the sag. This is avoided, in accordance with the invention, by operating the conveyor pass with a reduced drive speed, thereby restoring tension in the plow pass and allowing any increase in effective length to be transferred to the conveyor pass which is not detrimental. It has been found that correction should occur when incipient sag formation which, as has been noted, can be easily detected.

Specifically, the mining machine of the invention can comprise:

means forming a plow trough defining a guide for a mining plow displaceable against a seam to be mined, and a conveyor trough rearwardly of the plow trough;

reversing stations at opposite ends of the troughs and each formed with a respective sprocket wheel;

an endless chain passing around and engaged by the sprocket wheels and having a plow pass extending along the plow trough and a conveyor pass extending along the conveyor trough, the chain being under static tension between the sprocket wheels;

at least one mining plow on the chain for engagement with the seam while the mining plow is displaced along the plow trough by the plow pass for mining material from the seam, and at least one conveyor flight on the chain for entrainment of mined material along the conveyor trough while the conveyor flight is displaced along the conveyor trough;

a plow drive operatively connected to one of the sprocket wheels at a downstream end of the plow pass and a conveyor drive operatively connected to the other of the sprocket wheels at a downstream end of the conveyor pass for continuously displacing the chain;

at least one guide element along the chain downstream of the other sprocket wheel for guiding the plow onto the guide defined by the plow trough;

means for detecting development of a sag in the chain along the plow pass; and control means connected to the means for detecting and responsive to detection of the sag in the chain along the plow pass for reducing a speed of the conveyor drive to restore tension to the plow pass and permit any developing chain sag to collect only in the conveyor pass.

A method of operating a mining machine comprises:

means forming a plow trough defining a guide for a mining plow displaceable against a seam to be mined, and a conveyor trough rearwardly of the plow trough;

reversing stations at opposite ends of the troughs and each formed with a respective sprocket wheel;

an endless chain passing around and engaged by the sprocket wheels and having a plow pass extending along the plow trough and a conveyor pass extending along the conveyor trough, the chain being under static tension between the sprocket wheels;

at least one mining plow on the chain for engagement with the seam while the mining plow is displaced along the plow trough by the plow pass for mining material from the seam, and at least one conveyor flight on the chain for entrainment of mined material along the conveyor trough while the conveyor flight is displaced along the conveyor trough;

a plow drive operatively connected to one of the sprocket wheels at a downstream end of the plow pass and a conveyor drive operatively connected to the other of the sprocket wheels at a downstream end of the conveyor pass for continuously displacing the chain, the method comprising the steps of:

(a) advancing the troughs toward the mine seam with the mining plow engageable with material of the mine seam while driving the chain to mine material from the seam into the troughs as the plow is displaced along the plow pass;

(b) conveying mine material along the conveyer trough by displacement of the flight along the conveyer trough;

(c) detecting development of a sag in the chain along the plow pass; and (d) in response to detection of the sag in the chain along the plow pass, reducing a speed of the conveyor drive to restore tension to the plow pass and permit any developing chain sag to collect only in the conveyer pass.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
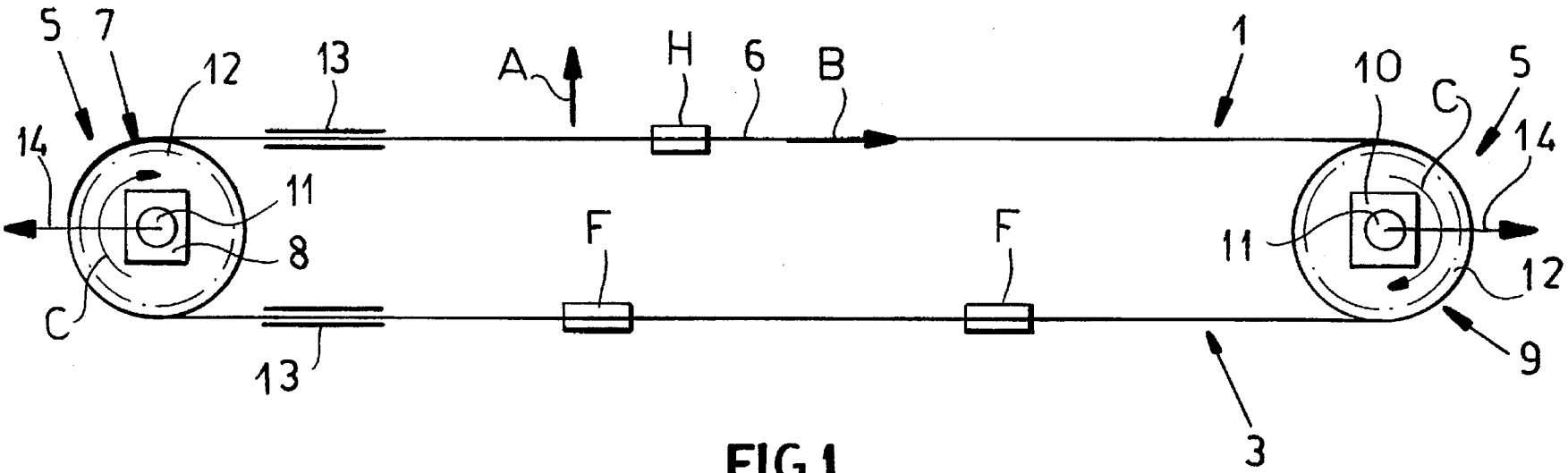
FIG. 1 is a diagrammatic plan view illustrating one aspect of the operation of a mining machine in accordance with the invention before sag formation.
Figure 2:
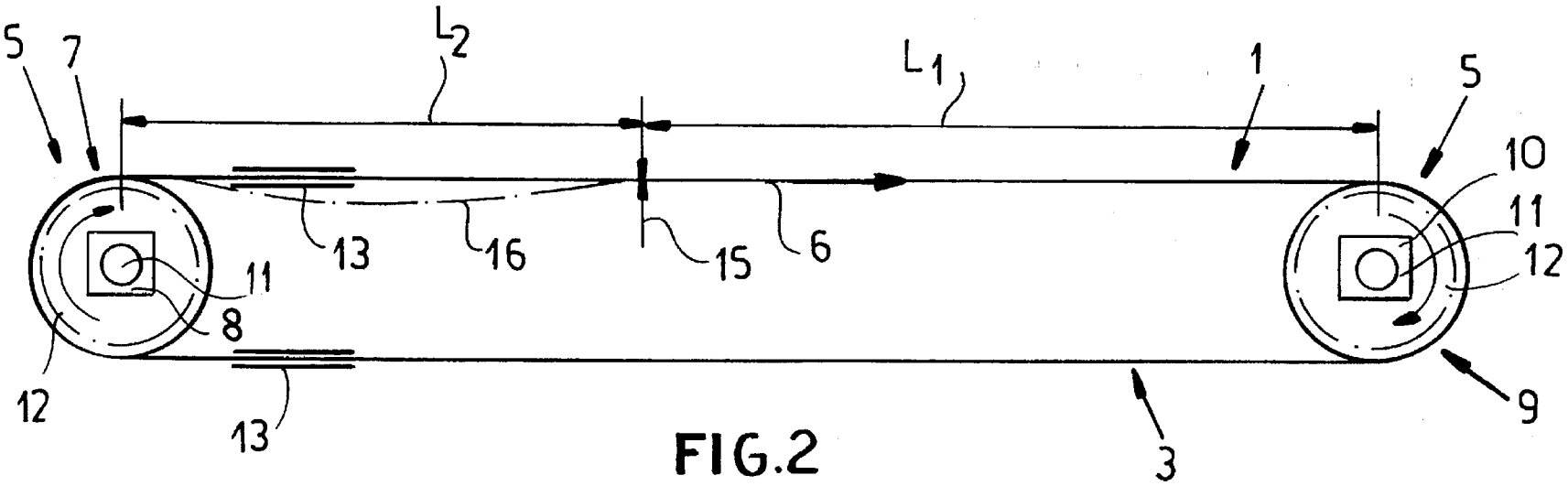
FIG. 2 is a view similar to FIG. 1 showing the development of sag.
Figure 3:
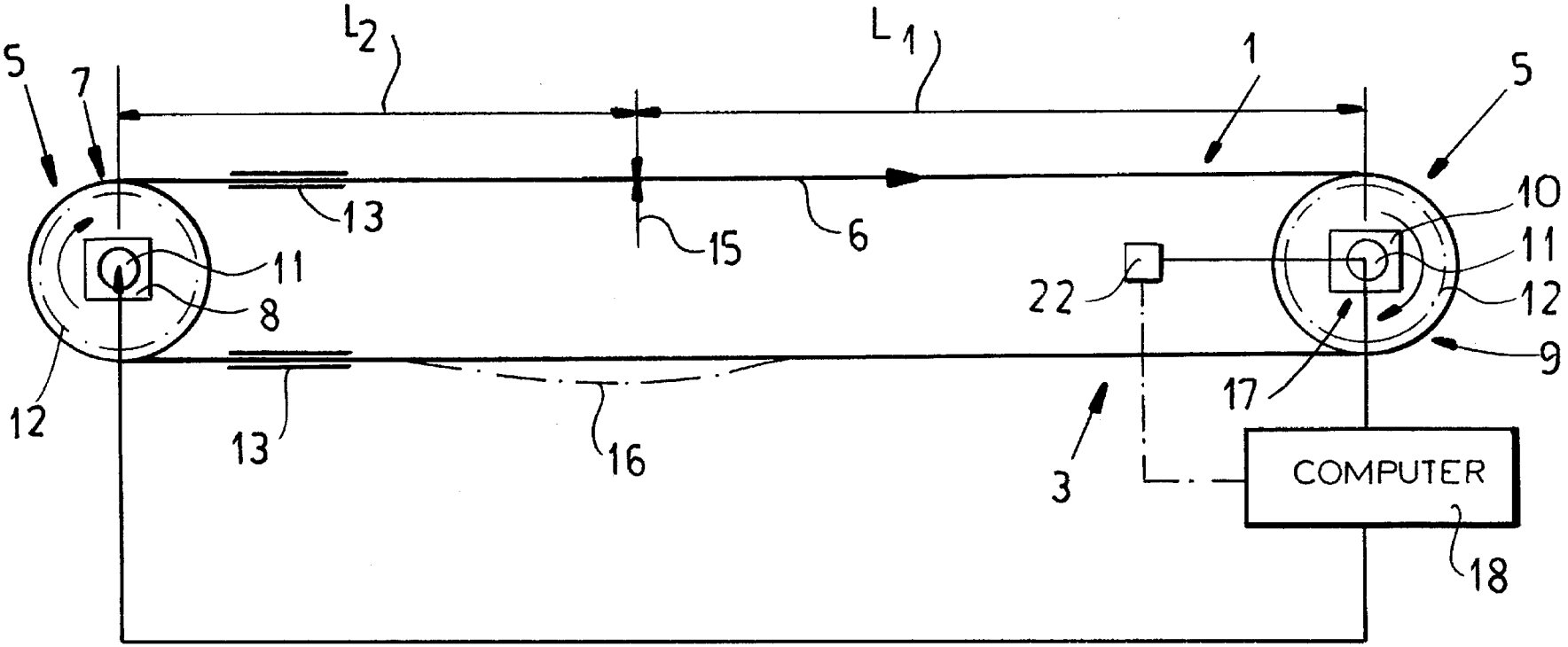
FIG. 3 illustrates the corrective effect of the invention.

FIGS. 1–3 show the principles involved in the invention with respect to continuously operating mining machines for the mining of mineral materials like coal which are present in seams which are attacked by the machine. The machine is assumed to be moving in the direction represented by the arrow A in FIG. 1 with the chain 6 driven in the direction of arrow B by sprocket wheels 12 which are rotatable in the same sense, i.e. the clockwise sense, as represented by the arrows C, also in FIG. 1.

The detailed construction of the apparatus has not been given. It is standard and can correspond to DE 43 19 512 A1.

Basically the apparatus comprises a plow pass 1 with a plow trough forming a track 2 for the plow, a conveyor pass 3 in a conveyor trough forming a conveyor track 4 and reversing stations at the ends of these troughs.

Figure 4:
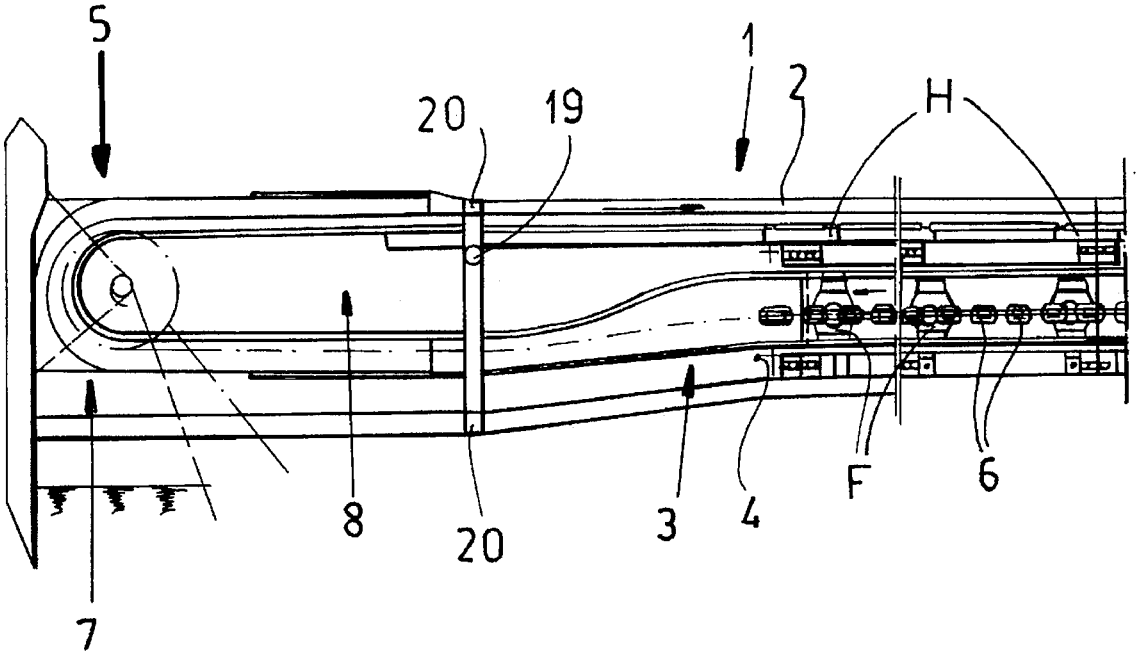
FIG. 4 is a plan view of a portion of a mining machine embodying the invention.

Within the plow trough and along the plow track 2 and within the conveyor trough and along the conveyor track 4, as well as around the reversing stations 5, plow bodies H and conveyor bodies F are guided as has been schematically illustrated in FIGS. 1–3 and are shown in greater detail in FIG. 4.

The plow bodies are coal plows mounted on the endless chain 6 which passes around the sprocket wheels 12 at the reversing stations 5 and is statically tensioned as represented by the arrows 14. The plows excavate the coal from the seam and the coal from the seam is dumped in the conveyor trough 4 where it is displaced by the conveyor bodies which are in the form of flights of a conventional flight conveyor for the displacement of mineral matter.

The chain 6 is driven in the region of the upstream end 7 of the plow track 2, i.e. at the downstream end of the conveyor pass, via a conveyor drive 8. In addition, the chain is driven in the region of the upstream end 9 of the conveyor path 4, i.e. at the downstream end of the plow path 2 by a plow drive 10. The two drives 8 and 10 thus displace the chain 6 collectively. The conveyor drive 8 and the plow drive 10 each comprise a drive shaft 11 connected to the respective sprocket wheel 12.

In the direction of circulation of the chain 6, immediately downstream of the sprocket wheel 12 of the conveyor drive 8, guide elements 13 are provided for feeding the plow H and the conveyor flights F into the respective guides of the plow track 2. These guide elements 13 have been shown only schematically in FIGS. 1–3.

The machine shown in FIG. 1 operates normally as to the plows H and the conveyor flights F. The chain 6 is under static tension as represented by the arrow 14. The friction forces in the plow trough and in the conveyor trough and hence along the plow pass 1 and the conveyor pass 3 are equal. The chain 6 in the two passes 1 and 3 is under the same tension. The drives 8 and 10 at the reversing stations operate with the same speeds. There is no sag or incipient sag in the chain.

However, as can be seen from FIG. 2, there are locations at which a clamping force is applied to the chain as represented by the opposing arrows 15 in FIG. 2 to apply a significant resistance to displacement of the plows and the chain. This can correspond to a stony region of the seam. This can be in the form of a momentary blockage of movement of the plow H. Since the plow drive 10 continues to operate in the region L1, the chain 6 is elastically extended. If the conveyer drive operates with the original speed or even a slightly reduced speed resulting from increased resistance, the chain stretch gives rise to a sag in the region L2 as represented at 16 in dot-dash lines in FIG. 2.

With a sag 16, of course, problems can arise, especially with respect to the proper feeding of the plows or the conveyer flights F into the guide elements 13 and thus into the plow track. Such track can extend the full length of the plow pass.

The formation of the sag 16 is a result of the fact that both drive 8 and 10 continue to operate with the same speed, resulting in an increased length of the chain the plow pass. A similar result can occur when the chain is not clamped or blocked but rather is impeded only by an increase in the resistance to movement of the plow bodies, because of geological conditions or the like.

FIG. 3 makes clear the fact that when a sag 16 occurs, the speed of drive 8 can be reduced. While there is an increase in the length in the plow pass 1 originally, a reduction in the speed of the conveyor drive 8 will retension the plow pass and thus eliminate the sag while transferring the sag 16 to the conveyor pass. In FIG. 3 we have represented at 17 the detection of a measurement of the speed of the sprocket 12 and the supply of the measured value to a computer 18 which controls the drive 8. In particular, a tachometer 22 can be provided to measure the speed at the sprocket wheel 12 on the right hand side of FIG. 3.

Figure 5:
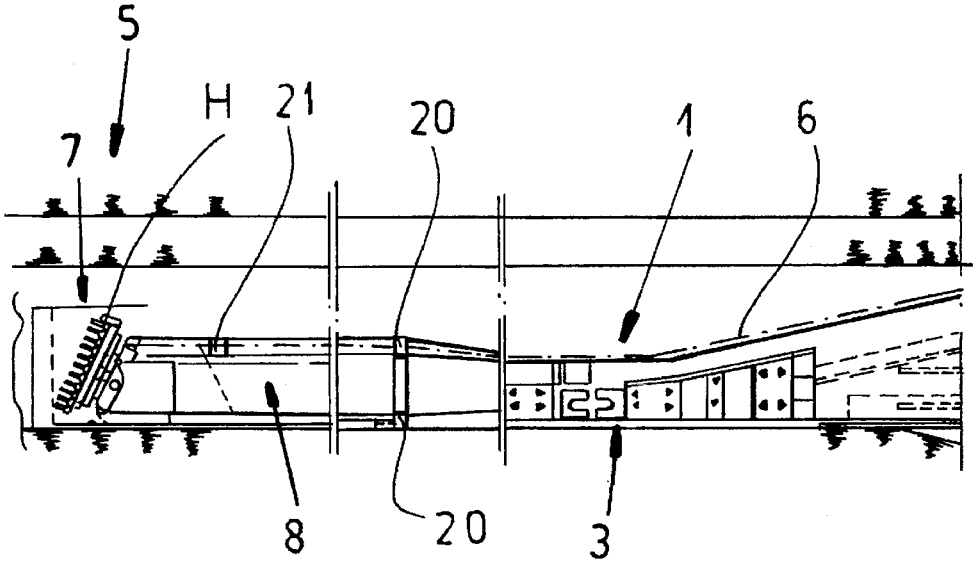
FIG. 5 is a side view of the portion of the machine of FIG. 4.

In FIGS. 4 and 5 as much as possible, the same reference numerals have been used to indicate elements described in connection with FIGS. 1–3. FIG. 4 shows a section of the continuously operating mining device and specifically the left hand part of the unit which has been represented more generally in FIG. 1–3. The plow pass 1 at least is provided with a device for detecting the chain sag and especially incipient sag to feed the measure of the sag to the computer 18. The computer 18 controls the conveyor drive 8 in accordance with the incipient sag and in such manner that the speed of the conveyor drive 8 is reduced in proportion to the sag formation, thereby retensioning the plow pass 1 and collecting any sag (FIG. 3) in the conveyor trough and along the conveyor pass.

More particularly, the reversing station 5 as shown in FIG. 4 and 5 in the region of the conveyor drive 8 has a linkage system 19 interconnecting the plow trough 2 and the conveyor trough 4 and which deforms or shifts in accordance with an offset between the two troughs resulting from a tension difference between the plow pass 1 and the conveyor pass 3. This can be measured by detectors 20 which can be force or displacement traducers to feed electrical signals representing the tension difference to the computer 18. The pick-ups 20 can supply such signals immediately upon the development of the sag.

The computer 18 can control a phase shifter or the like for a three-phase electric motor forming the conveyor drive 8 or a frequency source or the like so as to so reduce the drive speed of the conveyor drive 8 that the chain 6 is retensioned along the entire path of the plow pass.

From FIG. 5 it will be apparent that sensors 21 can be provided to respond to the geometry of an incipient sag. FIG. 3 shows that the sensor can be a safety measuring device 22 or tachometer which measures the speed of the sprocket wheel 12 driven by the plow drive 10. In all cases the outputs of the sensors is delivered to the computer.

We claim:

1. A mining machine for seam mining comprising:

means forming a plow trough defining a guide for a mining plow displaceable against a seam to be mined, and a conveyor trough rearwardly of said plow trough;

reversing stations at opposite ends of said troughs and each formed with a respective sprocket wheel;

an endless chain passing around and engaged by said sprocket wheels and having a plow pass extending along said plow trough and a conveyor pass extending along said conveyor trough, said chain being under static tension between said sprocket wheels;

at least one mining plow on said chain for engagement with said seam while said mining plow is displaced along said plow trough by said plow pass for mining material from said seam, and at least one conveyor flight on said chain for entrainment of mined material along said conveyor trough while said conveyor flight is displaced along said conveyor trough;

a plow drive operatively connected to one of said sprocket wheels at a downstream end of said plow pass and a conveyor drive operatively connected to the other of said sprocket wheels at a downstream end of said conveyor pass for continuously displacing said chain;

at least one guide element along said chain downstream of said other sprocket wheel for guiding said plow onto the guide defined by said plow trough;

means for detecting development of a sag in said chain along said plow pass; and control means connected to said means for detecting and responsive to detection of said sag in said chain along said plow pass for reducing a speed of said conveyor drive to restore tension to said plow pass and permit any developing chain sag to collect only in said conveyor pass.

2. The mining machine defined in claim 1 wherein said means for detecting development of a sag in said chain along said plow pass includes means for detecting a change in chain tension on opposite sides of said other sprocket wheel.

3. The mining machine defined in claim 1 wherein said means for detecting development of a sag in said chain along said plow pass includes means for detecting a change in speed of said one of said sprocket wheels to which said plow drive is coupled.

4. The mining machine defined in claim 1 wherein said means for detecting development of a sag in said chain along said plow pass includes a sensor responsive to chain sag in a region of the sprocket wheel provided with said conveyor drive.

5. The mining machine defined in claim 1 wherein said means for detecting development of a sag in said chain along said plow pass includes a linkage connecting said troughs and means for detecting a relative shift in said troughs resulting from tension differences along said passes.

6. The mining machine defined in claim 1 wherein said means for detecting development of a sag in said chain along said plow pass includes an angular velocity sensor for said one of said sprocket wheels.

7. The mining machine defined in claim 1 wherein said control means includes a computer.

8. A method of operating a mining machine for seam mining which comprises:

means forming a plow trough defining a guide for a mining plow displaceable against a seam to be mined, and a conveyor trough rearwardly of said plow trough;

reversing stations at opposite ends of said troughs and each formed with a respective sprocket wheel;

an endless chain passing around and engaged by said sprocket wheels and having a plow pass extending along said plow trough and a conveyor pass extending along said conveyor trough, said chain being under static tension between said sprocket wheels;

at least one mining plow on said chain for engagement with said seam while said mining plow is displaced along said plow trough by said plow pass for mining material from said seam, and at least one conveyor flight on said chain for entrainment of mined material along said conveyor trough while said conveyor flight is displaced along said conveyor trough;

a plow drive operatively connected to one of said sprocket wheels at a downstream end of said plow pass and a conveyor drive operatively connected to the other of said sprocket wheels at a downstream end of said conveyor pass for continuously displacing said chain, said method comprising the steps of:

(a) advancing said troughs toward said mine seam with said mining plow engageable with material of said mine seam while driving said chain to mine material from said seam into said troughs as said plow is displaced along said plow pass;

(b) conveying mine material along said conveyer trough by displacement of said flight along said conveyer trough;

(c) detecting development of a sag in said chain along said plow pass; and (d) in response to detection of said sag in said chain along said plow pass, reducing a speed of said conveyor drive to restore tension to said plow pass and permit any developing chain sag to collect only in said conveyer pass.

9. The method defined in claim 8 wherein development of sag in said chain along said plow pass is detected by monitoring a change in chain tension on opposite sides of said other sprocket wheel.

10. The method defined in claim 9 wherein said troughs are connected by a linkage and a change in chain tension of opposite sides of said other sprocket wheel is detected by monitoring an offset of one of said troughs relative to the other of said troughs.

11. The method defined in claim 8 wherein the detection of development of said sag in said chain is effected by providing sensors in a region of said other sprocket wheel.

* * * * *